US006187738B1

(12) United States Patent
Micciche et al.

(10) Patent No.: US 6,187,738 B1
(45) Date of Patent: Feb. 13, 2001

(54) STABLE COMPOSITIONS FOR REMOVING STAINS FROM FABRICS AND CARPETS

(75) Inventors: Robert P. Micciche, Somerset; Ann Marie Lynch, Glen Rock; Uma Tripathi, Gladstone; Carol Belansky, Roselle Park, all of NJ (US)

(73) Assignee: Playtex Products, Inc., Westport, CT (US)

( * ) Notice: Under 35 U.S.C. 154(b), the term of this patent shall be extended for 0 days.

(21) Appl. No.: 09/243,086

(22) Filed: Feb. 2, 1999

Related U.S. Application Data

(60) Provisional application No. 60/073,447, filed on Feb. 2, 1998.

(51) Int. Cl.[7] ..... C11D 1/75

(52) U.S. Cl. ..... 510/278; 510/275; 510/281; 510/286; 510/290; 510/302; 510/309; 510/405; 510/406; 510/414; 510/503

(58) Field of Search ..... 510/278, 279, 510/281, 286, 290, 302, 309, 405, 406, 414, 503

(56) References Cited

U.S. PATENT DOCUMENTS

| | | |
|---|---|---|
| Re. 35,000 | 7/1995 | Aoyagi et al. . |
| 4,129,514 | 12/1978 | Caffarel et al. . |
| 4,145,183 | 3/1979 | Bostwick . |
| 4,282,109 | 8/1981 | Citrone et al. . |
| 4,329,244 | 5/1982 | Brichard et al. . |
| 4,430,236 | 2/1984 | Franks . |
| 4,486,338 | 12/1984 | Ootani et al. . |
| 4,490,285 | 12/1984 | Kebanli . |
| 4,525,291 | 6/1985 | Smith et al. . |
| 4,548,757 | 10/1985 | Wevers et al. . |
| 4,587,030 | 5/1986 | Casey . |
| 4,595,526 | 6/1986 | Lai . |
| 4,595,527 | 6/1986 | Gipp . |
| 4,606,842 | 8/1986 | Keyes et al. . |
| 4,612,137 | 9/1986 | Kuroda et al. . |
| 4,655,781 | 4/1987 | Hsieh et al. . |
| 4,656,043 | 4/1987 | Hawkins et al. . |
| 4,725,319 | 2/1988 | Osberghaus . |
| 4,728,455 | 3/1988 | Rerek . |
| 4,767,625 | 8/1988 | Mitsuno et al. . |
| 4,800,036 | 1/1989 | Rose et al. . |
| 4,806,259 | 2/1989 | Amjad . |
| 4,834,900 | 5/1989 | Soldanski et al. . |
| 4,857,225 | 8/1989 | Terada et al. . |
| 4,861,516 | 8/1989 | Kurzendoerfer et al. . |
| 4,863,629 | 9/1989 | Osberghaus et al. . |
| 4,941,989 | 7/1990 | Kramer et al. . |
| 4,983,317 | 1/1991 | Requejo et al. . |
| 5,047,168 | 9/1991 | Broze et al. . |
| 5,078,896 | 1/1992 | Rorig et al. . |
| 5,139,705 | 8/1992 | Wittpenn, Jr. et al. . |
| 5,160,655 | 11/1992 | Donker et al. . |
| 5,186,856 | 2/1993 | Holland . |
| 5,238,609 | 8/1993 | Smith et al. . |
| 5,244,593 | 9/1993 | Roselle et al. . |
| 5,271,860 | 12/1993 | Schwadtke et al. . |
| 5,292,955 | 3/1994 | Smith et al. . |
| 5,296,239 | 3/1994 | Colery et al. . |
| 5,338,475 | 8/1994 | Corey et al. . |
| 5,348,682 | 9/1994 | Finley et al. . |
| 5,389,278 | 2/1995 | Minns et al. . |
| 5,389,305 | 2/1995 | Repinec et al. . |
| 5,399,285 | 3/1995 | Kanluen . |
| 5,419,847 | 5/1995 | Showell et al. . |
| 5,492,540 | 2/1996 | Leifheit et al. . |
| 5,498,373 | 3/1996 | Miller et al. . |
| 5,507,971 | 4/1996 | Ouzounis et al. . |
| 5,522,580 | 6/1996 | Varner, Jr. et al. . |
| 5,536,438 | 7/1996 | Scialla et al. . |
| 5,559,090 | 9/1996 | Scialla et al. . |
| 6,008,175 * | 12/1999 | Scialla et al. ..... 510/278 |

* cited by examiner

*Primary Examiner*—Necholus Ogden
(74) *Attorney, Agent, or Firm*—Ohlandt, Greeley, Ruggiero & Perle, LLP

(57) ABSTRACT

There is provided an aqueous composition for cleaning fabrics and carpets and inhibiting the resoiling of fabric and carpets. The composition includes a peroxygen compound, a surfactant system, and a polymeric or copolymeric soil resist. The resulting compositions are particularly stable and non-turbid.

17 Claims, No Drawings

STABLE COMPOSITIONS FOR REMOVING STAINS FROM FABRICS AND CARPETS

This application claims priority from Provisional Application No. 60/073,447 that was filed on Feb. 2, 1998.

BACKGROUND OF THE INVENTION

I. Field of the Invention

The present invention relates to aqueous compositions capable of removing stains from fabrics and carpets. Specifically, the present invention relates to aqueous compositions for removing water and protein stains from fabrics and carpets. Such compositions contain one or more peroxygen compounds and at least one surfactant. More specifically, the present invention relates to such compositions that exhibit superior solution stability and reduced turbidity.

II. Description of the Prior Art

Fabric and carpet fibers easily stain upon contact with water and proteinaceous materials. Such stains are conventionally removed by compositions containing combinations of cleansing surfactants that lift and remove water and protein stains from the fabric. Stain remover compositions may also be formulated to further contain an active oxygen-containing compound (more commonly referred to as a peroxygen compound), such as hydrogen peroxide. Peroxygen compounds oxidize and decolorize stains formed by contact with water and proteinaceous materials.

Fabric cleaning compositions also commonly contain one or more anti-resoiling agents, commonly referred to as soil resists. Soil resists prevent or impede the resoiling of the fabric after cleaning. One type of soil resist, an olefinic/acrylate polymer, is described in U.S. Pat. No. 5,534,167 to Billman. See also U.S. Pat. No. 5,001,004 to Fitzgerald et al. In surfactant-containing cleaning compositions, a polymeric or copolymeric soil resist embrittles the surfactants upon drying. Embrittlement prevents the surfactants from drying into a waxy, tacky layer that remains on the fabric after removal of the cleaning composition. If left on the fabric, such a waxy, tacky layer will attract and hold dirt on the surface of the cleaned fabric.

In addition to providing acceptable stain removal ability, stain removal compositions must be storage stable. A stain removal product may be stored by the ultimate consumer for many months before use under less than ideal conditions. During storage, the components of the composition cannot separate from each other if the composition is to remain fully effective. Furthermore, the composition cannot become turbid as a turbid product is not acceptable to the consumer. The problem of compositional instability is further exacerbated when a peroxygen compound is employed. Peroxygen compounds easily degrade and the decolorizing ability of a peroxygen compound is quickly lost upon degradation. Furthermore, degradation of a peroxygen compound generates gases that can cause swelling of the package in which the stain removing composition is provided.

SUMMARY OF THE INVENTION

It is an object of the present invention to provide an aqueous stain-removing composition for removing water and protein-type stains from fabrics and carpets.

It is also an object of the present invention to provide such a composition that will further prevent or inhibit the resoiling of the cleaned fabrics and carpet.

It is another object of the present invention to provide such a composition that includes a surfactant system, a peroxygen compound and a polymeric or copolymeric soil resist.

It is a still further object of the present invention to provide such a composition in which all ingredients are selected such that all are compatible and form a stable, non-turbid solution.

To accomplish the foregoing objects and advantages, the present invention, in brief summary, is a clear, stable, stain removing solution comprising: a peroxygen compound; a surfactant system; and a polymeric or copolymeric soil resist.

DETAILED DESCRIPTION OF THE INVENTION

The compositions of the present invention are aqueous cleaning compositions. Such compositions are stain removing compositions containing one or more peroxygen compounds, one or more surfactants, and one or more polymeric or copolymeric soil resists. Optionally, the composition may contain additional components, such as a preservative, a stabilizer/pH controller, and a fragrance.

It has been found that by proper selection of the cleansing surfactants, a stable, non-turbid solution can be formed in the presence of the peroxygen compound and the polymeric or copolymeric soil resist. Such stability provides for more latitude in formulating the cleaning composition, allows for the use of reduced amounts of a stabilizer compound (chelating agent), and results in a superior and stable product.

The compositions of the present invention include from about 0.2 to about 6.0 percent by weight (wt. %), preferably from about 1.0 to about 4.0 wt. %, and most preferably from about 2.5 to about 3.5 wt. %, of a peroxygen compound. Peroxygen compounds suitable for use in the present invention include hydrogen peroxide and T-butyl hydroperoxide. The use of hydrogen peroxide is preferred. It is conventional in the art to use an industrial grade hydrogen peroxide in the formation of cleaning products. However, it has been found that the use of a higher purity hydrogen peroxide, such as hydrogen peroxide sold under the name Super D™, a product of EMC (USA), or Ultracosmetic™ grade provided by Solvay Interox Inc., (USA) provides the composition with an improved stability that justifies the higher initial costs of such peroxides.

The total amount of surfactant in the compositions of the present invention is from about 0.2 to about 6.0 wt. %, preferably from about 0.5 to about 3.0 wt. %, and most preferably from about 1.0 to about 1.5 wt. %. Surfactants suitable for use in the surfactant system of the present compositions include anionic, cationic, nonionic and zwitterionic surfactants, which are all well known in the art. Preferably, the compositions of the present invention include anionic and/or nonionic surfactants. Most preferably, the compositions include a mixture of anionic and nonionic surfactants.

Suitable anionic surfactants include, for example, alcohol sulfates (e.g. alkali metal or ammonium salts of alcohol sulfates) and sulfonates, alcohol phosphates and phosphonates, alkyl sulfonates, alkylaryl sulfonates, alkali metal or ammonium salts of fatty acids, sulfonated amines, sulfonated amides, fatty sarcosinates such as sodium lauroyl sarcosinate, linear alkylated sulfonates such as alkylbenzene sulfonates where the R-group is attached between $C_6$–$C_{15}$, alcohol ether sulfates such as those with the structure R=$C_8$–$C_{15}$ and where ethoxylation is between 1–7, secondary alkane sulfonates such as the Hostapur SAS series supplied by Hoechst Celanese, and mixtures thereof. A more complete list of anionic surfactants is provided in McCutcheon's, Volume 1, Emulsifiers and Detergents, pp. 280–283 (1997), which is incorporated herein by reference. Preferred anionic surfactants for use in the compositions of the present invention include sodium lauryl sulfate and sodium lauroyl sarcosinate.

Nonionic surfactants suitable for use in the compositions of the present invention include, for example, ethoxylated and propoxylated alcohols such as linear alkyl alcohol ethoxylates from the Neodol series that are available from Shell, ethylene oxide/propylene oxide copolymers, ethoxylated and propoxylated fatty acids, ethoxylated and propoxylated alkyl phenols, alkyl polyglycosides, alkyl secondary alcohol ethoxylates, and n-alkylpyrrolidones such as caprylyl pyrrolidone and lauryl pyrrolidone, amine oxides, and mixtures thereof. Particularly, fatty amine oxides such as lauramine oxide, alkyl ethoxylated amine oxides such as $C_{12}$–$C_{15}$ diethanol amine oxide, and ether amine oxides. A more complete list of nonionic surfactants is also provided in McCutcheon's, supra, pp. 283–289. The most preferred nonionic surfactants are lauramine oxide and $C_{11}$–$C_{15}$ Pareth 7 (a $C_{11}$–$C_{15}$ alkyl secondary alcohol ethoxylate) sold by Union Carbide under the tradename Tergitol 15-S-7.

Among the suitable zwitterionic surfactants that can be used in the composition are betaines. For example, cocoamidopropyl betaine, which is supplied by Hoechst Celanese under the tradename Genagen CAB, can be used.

The compositions of the present invention further include from about 0.1 to about 4.0 wt. %, preferably from about 0.2 to about 2.0 wt. %, most preferably from about 0.3 to about 0.9 wt. %, of a polymeric or copolymeric soil resist. Suitable polymeric or copolymeric soil resists include polymers derived from monomers of acrylic acid, methacrylic acid, methacrylate, methyl-methacrylate, ethyl acrylate and maleic acid, as well as copolymers derived from the above monomers and olefin. The acrylic acid portion of the polymeric or copolymeric soil resist can be in the form of free acid, or a water soluble salt of acrylic acid (e.g., alkali metal salts, ammonium salts and amine salts). In addition, polyvinylpyrrolidone (PVP) and fluorinated hydrocarbon soil resists may be used. The Zonyl series from DuPont is one such example of a fluorinated hydrocarbon soil resist.

Preferably, the polymeric or copolymeric soil resist is a mixture of acrylate polymers having a wide range of molecular weights. The preferred polymeric or copolymeric soil resist is a water-based carboxylated acrylic copolymer sold by Interpolymer Corporation under the trade name Syntran DX6-125. The Syntran DX6-125 soil resist is a water-eased dispersion containing about 20 wt. % of a copolymer of methacrylic acid, methylmethacrylate and styrene, having a number average molecular weight of about 6000 to about 8000. This dispersion has a specific gravity of about 1.055, a pH at 22° C. of about 8, and a viscosity at 22° C. of about 1000 cps (Brookfield) maximum.

The pH of each composition of the present invention is from about 5.0 to about 8.0 and preferably from about 5.5 to about 7.0. The pH can be adjusted within this range by the addition of a stabilizer/pH controller. Basically, this stabilizer/pH controller stabilizes the composition and controls the pH of the composition. The stabilizer/pH controller is a chelating agent/acidifying agent. The stabilizer/pH controller is present in an amount from about 0.4 wt. % to about 0.12 wt. % to obtain a pH from about 5.5 to about 7.0, respectively. The control of the compositional pH is critical as an increased pH can cause the degradation of the peroxygen compound.

In addition to controlling the pH of the final composition, it is also important to control the pH of the composition at the point the peroxygen compound is added. Thus, it is preferable to mix the surfactants, soil resist and preservative first, then add the stabilizer/pH controller as needed to provide a suitable pH to the composition, at which time the peroxygen compound can be added. The order of addition may be modified, however, the peroxide is advantageously added at a point after which the pH of the composition will not be above about 9.5, and will preferably not rise above about 7.5.

Optionally, a solvent system may be included in the composition. In general, organic solvents may be used. Preferably, solvents such as glycol ethers (e.g., propylene glycol methyl ether, dipropylene glycol methyl ether, tripropylene glycol methyl ether), methanol, ethanol, isopropanol, hexylcellosolve and butylcellosolve can be used.

A preferred composition of the present invention will contain from about 0.2 to about 6.0 wt. % of a peroxygen compound, about 0.2 to about 6.0 wt. % of a surfactant system and from about 0.1 to about 4.0 wt. % of a polymeric or copolymeric oil resist. A more preferred composition of the present invention will contain from about 1.0 to about 4.0 wt. % of a peroxygen compound, about 0.5 to about 3.0 wt. % of a surfactant system and from about 0.2 to about 2.0 wt. % of a polymeric or copolymeric soil resist.

A most preferred composition of the present invention will contain from about 2.5 to about 3.5 wt. % of a peroxygen compound, about 1.0 to about 1.5 wt. % of a surfactant system including a mixture of anionic and nonionic surfactants, from about 0.3 to about 0.9 wt. % of a polymeric or copolymeric soil resist, and from about 0.3 to about 0.12 wt. % of a stabilizer/pH controller that will provide the composition with a pH of about 5.5 to about 7.0. The compositions of the present invention can also contain additional components commonly used in cleaning solutions. Such additional components include, but are not limited to, a preservative and a fragrance.

EXAMPLE 1

A cleaning composition of the present invention was formed with the following ingredients in amounts expressed as percent by weight of the total weight of the composition:

| Ingredient | Type of Ingredient | Wt. % Active |
|---|---|---|
| Water | Carrier | 94.77 |
| Hydrogen Peroxide | Oxidizing Agent | 3.00 |
| Acrylate Copolymer | Polymeric Soil Resist | 0.60 |
| Sodium Lauryl Sulfate | Surfactant | 0.60 |
| C11-15 Pareth 7 | Surfactant | 0.25 |
| Sodium Lauroyl Sarcosinate | Surfactant | 0.23 |
| Lauramine Oxide | Surfactant | 0.07 |
| Fragrance | | 0.15 |
| Dequest 2010* | Stabilizer/pH Controller | 0.25 |
| Surcide-P** | Preservative | 0.08 |

*1-hydroxyethylidene-1,1-diphosphonic acid
**hexahydro-1,3,5-tris(2-hydroxyethyl)-s-triazine The following examples of soil removal performance illustrate the effectiveness of this invention for removing water and protein based stains from fabrics and carpets.

EXAMPLE 2

Testing was performed at a testing laboratory to demonstrate the ability of the composition of Example 1 in removing common stains typically found on rugs and carpets. A 25 ounce/square yard cut pile nylon carpet was used for test purposes. Liquid and semi-viscous liquids were uniformly applied in a one inch diameter ring. The balance of the staining agents were applied as uniformly as possible consistent with standard laboratory practice. All stains were applied in duplicate. In all, thirteen stains were evaluated. The cleaning procedure was initiated after a one hour dwell period. The test procedure used was as follows:

1. The stain was blotted repeatedly using weighted white paper towels until no transfer occurred.

2. Seven grams of cleaning agent were applied to the stain for a period of approximately one minute.

3. A damp colorfast sponge was used to rub the cleaning agent into the stain, thirty times in a back and forth motion. Then the sponge was rinsed and used again to rub the cleaning agent into the stain an additional thirty times.

4. Pile distortion was erected using a comb.

5. Test material was allowed to dry at ambient temperature, then vacuumed using five forward and five reverse strokes with a commercial upright beater bar vacuum.

6. A panel of three technicians assessed the appearance of the stain using AATCC Gray Scale Procedure One (see below).

| Gray Scale | |
|---|---|
| 5 | Negligible or no change |
| 4 | Slight Change |
| 3 | Noticeable change |
| 2 | Considerable change |
| 1 | Severe change |

The scale is used to compare a stain that has been cleaned against an unstained fabric. A rating of 5 indicates that the remnants of the stain are negligible or undetectable and a rating of 1 indicates a severe difference between the stain that has been cleaned against an unstained fabric.

7. Staining agents that upon removal did not score at least a 4 rating, were cleaned one or two additional times following the above outlined procedure prior to final assessment. Results of this study are set forth in Table 1.

TABLE 1

| Staining Agent | Rating |
|---|---|
| Beer | 5 |
| Blood | 5 |
| Cola | 5 |
| Dairy Milk | 5 |
| Dirt | 5 |
| Gerber Carrots | 4–5 |
| Gerber Mixed Vegetables | 4–5 |
| Grape Jelly | 5 |
| Grape Juice | 5 |
| Hot Tea | 4 |
| Latex-Based Paint | 4 |
| Mud | 5 |
| Chocolate | 4–5 |

Results of this cleaning study clearly indicate the effectiveness of this invention in removing water and protein based stains.

EXAMPLE 3

Certain commonly found stains on both fabrics and carpets are more difficult to remove due to their inherent chemical nature. They represent a true challenge for typical cleaners. Stains such as red wine, coffee, and chocolate fall into this category. The following example demonstrates the effectiveness of the composition of Example 1 at removing such stains.

100% nylon carpet swatches were used for testing purposes. Staining and cleaning procedures employed were typical of those presently used in the carpet cleaning industry and should be familiar to those skilled in the art. Red wine, coffee, and chocolate were applied to swatches in 5 grams, 5 grams, and 1 gram amounts, respectively. The cleaning procedure was initiated after 24 hours. For each stain, 7 grams of the composition of Example 1 were applied. Each sample was allowed to sit for approximately 3 minutes to allow penetration of the cleaning solution into the stain. A damp colorfast sponge was then used to rub the stain thirty times back and forth. The sponge was rinsed, then the stain was rubbed an additional thirty times back and forth. Test material was allowed to dry at ambient temperature and then vacuumed. A twenty person in-house panel rated the performance by evaluating the appearance of the stains using the AATCC Gray Scale Procedure.

Results are shown in Table 2:

TABLE 2

| Stain | Mean | Standard Deviation |
|---|---|---|
| Red Wine | 5.0 | 0.2 |
| Coffee | 3.7 | 0.9 |
| Chocolate | 4.9 | 0.4 |

Results from this soil removal evaluation clearly illustrate the superior cleaning performance of this invention on more difficult to remove common household stains.

Stability Testing

The peroxygen stability of the composition of Example 1 was tested by the following method:

A 5 g test sample of the composition of Example 1 was placed in a 250 mL Erlenmeyer flask. 50 mL of deionized water and 10 mL of 25% sulfuric acid were then pipetted into the flask to form a mixture. The resulting mixture was titrated with an amount of 0.5 N potassium permanganate sufficient to achieve a pink endpoint that persists for at least 30 seconds. The procedure was then repeated using a blank sample, and the amount of remaining hydrogen peroxide was determined according to the following formula:

$$\% \text{ Hydrogen Peroxide} = \frac{(V_1 - V_2) \times N \times 1.701}{W}$$

wherein:

$V_1$=mL of potassium permanganate required by the sample;

$V_2$=mL of potassium permanganate required by the blank;

N=normality of the potassium permanganate solution; and

W=weight of the sample (in grams).

Based on the percent hydrogen peroxide remaining, the stability of the composition of Example 1 was determined after two weeks, four weeks, two months, and four months at room temperature (25° C.) and at 38° C. At 45° C., the percentage of hydrogen peroxide remaining was determined after two weeks and four weeks. The samples were also visually evaluated after each temperature condition, and after three freeze (−4° C.)/thaw cycles. The results of the stability test are shown in Table 3.

TABLE 3

| | % Hydrogen Peroxide | | |
|---|---|---|---|
| | RT | 38° C. | 45° C. |
| Initial | 3.02 | 3.02 | 3.02 |
| 2 Weeks | 3.01 | 2.99 | 2.94 |
| 4 Weeks | 3.00 | 3.00 | 2.96 |
| 2 Months | 2.96 | 2.95 | — |
| 4 Months | 2.99 | 2.96 | — |

The above data demonstrates the excellent stability of the compositions of the present invention. Visual inspection of the aged samples at their respective time and temperature conditions showed the samples to be visually acceptable (clear, no sediment). The fragrances of the samples were also found to be acceptable. After three freeze/thaw cycles the solution remained clear with no visible phase separation or precipitation.

The present invention has been described with particular reference to the preferred forms thereof. It will be obvious to one of ordinary skill in the art that changes and modifications may be made therein without departing from the spirit and scope of the present invention as defined by the following claims.

What is claimed is:

1. A fabric cleaning composition comprising:

a peroxygen compound;

a surfactant system consisting of lauramine oxide, $C_{11-15}$ Pareth 7, sodium lauryl sulfate, and sodium lauroyl sarcosinate; and a polymeric or copolymeric soil resist, wherein the resulting cleaning composition is stable and non-turbid.

2. The fabric cleaning composition of claim 1, further comprising a stabilizer/pH controller.

3. The fabric cleaning composition of claim 1, wherein said peroxygen compound is about 0.2 to about 6.0 wt. % of the total weight of the composition.

4. The fabric cleaning composition of claim 1, wherein said peroxygen compound is selected from the group consisting of hydrogen peroxide, T-butyl hydroperoxide, and mixtures thereof.

5. The fabric cleaning composition of claim 4, wherein said peroxygen compound is hydrogen peroxide.

6. The fabric cleaning composition of claim 5, wherein said hydrogen peroxide is high purity hydrogen peroxide.

7. The fabric cleaning composition of claim 1, wherein said surfactant system is about 0.2 to about 6.0 wt. % of the total weight of the composition.

8. The fabric cleaning composition of claim 1, further comprising a betaine.

9. The fabric cleaning composition of claim 1, wherein said polymeric or copolymeric soil resist is about 0.1 to about 4.0 wt. % of the total weight of the composition.

10. The fabric cleaning composition of claim 1, wherein said polymeric or copolymeric soil resist is selected from the group consisting of polymers derived from monomers of acrylic acid, methacrylic acid, methacrylate, methylmethacrylate, ethyl acrylate, maleic acid, copolymers derived from the above monomers, olefin, polyvinylpyrrolidone, and mixtures thereof.

11. The fabric cleaning composition of claim 2, wherein said stabilizer/pH controller is a chelating agent/acidifying agent.

12. The fabric cleaning composition of claim 2, wherein said stabilizer/pH controller is about 0.4 wt. % to about 0.12 wt. %.

13. A cleaning composition comprising:

from about 2.5 to about 3.5 wt. % of a peroxygen compound;

from about 1.0 to about 1.5 wt. % of a surfactant system consisting of lauramine oxide, $C_{11-15}$ Pareth 7, sodium lauryl sulfate, and sodium lauroyl sarcosinate;

from about 0.3 to about 0.9 wt. % of a polymeric or copolymeric soil resist; and from about 0.3 to about 0.12 wt. % of a stabilizer/pH controller, wherein the pH of the composition is about 5.5 to about 7.0.

14. A cleaning composition comprising:

from about 0.2 to about 6.0 wt. % of a peroxygen compound;

from about 0.2 to about 6.0 wt. % of a surfactant system consisting of lauramine oxide, $C_{11-15}$ Pareth 7, sodium lauryl sulfate, and sodium lauroyl sarcosinate; and from about 0.1 to about 4.0 wt. % of a polymeric or copolymeric soil resist.

15. A cleaning composition of claim 14, wherein the peroxygen compound is from about 1.0 to about 4.0 wt. %;

the surfactant system is from about 0.5 to about 3.0 wt. %; and the polymeric or copolymeric soil resist is from about 0.2 to about 2.0 wt. %.

16. A process for making a cleaning composition comprising the steps of:

adding water to a mixing tank;

adding a surfactant system consisting of lauramine oxide, $C_{11-15}$ Pareth 7, sodium lauryl sulfate, and sodium lauroyl sarcosinate to the mixing tank;

adding a polymeric or copolymeric soil resist to the mixing tank;

adding a stabilizer/pH controller to adjust the pH, forming a stabilized system such that the pH of said stabilized system is about 9.5 or less; and adding a peroxygen compound to said stabilized system, wherein the cleaning composition has a pH of about 7.5 or less.

17. A fabric cleaning composition comprising:

water;

hydrogen peroxide;

acrylate copolymer;

sodium lauryl sulfate;

$C_{11-15}$ Pareth 7;

sodium lauroyl sarcosinate;

lauramine oxide;

fragrance;

1-hydroxyethylidene-1,1-diphosphonic acid; and hexahydro-1,3,5-tris(2-hydroxyethyl)-s-triazine.

* * * * *